US008033870B2

(12) United States Patent
Xie

(10) Patent No.: US 8,033,870 B2
(45) Date of Patent: Oct. 11, 2011

(54) ELECTRICAL CONNECTOR HAVING CONTACT TERMINAL WITH CUTOUT RECEIVING DEPRRESSED CONTACT ARM

(75) Inventor: Bin Xie, Kunshan (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/978,361

(22) Filed: Dec. 23, 2010

(65) Prior Publication Data

US 2011/0151720 A1 Jun. 23, 2011

(30) Foreign Application Priority Data

Dec. 23, 2009 (CN) ..... 2009 2 0318121

(51) Int. Cl.
*H01R 24/00* (2011.01)

(52) U.S. Cl. ..... 439/660

(58) Field of Classification Search ..... 439/660, 439/862, 500, 884, 668, 441
See application file for complete search history.

(56) References Cited

U.S. PATENT DOCUMENTS

| | | | | |
|---|---|---|---|---|
| 6,077,130 | A * | 6/2000 | Hughes et al. | 439/862 |
| 6,875,049 | B2 * | 4/2005 | Kyowski et al. | 439/500 |
| 6,893,286 | B2 * | 5/2005 | Drewes et al. | 439/441 |
| 7,331,825 | B2 * | 2/2008 | Xue et al. | 439/668 |
| 2002/0048999 | A1 * | 4/2002 | Ming-Hui | 439/660 |
| 2010/0035488 | A1 * | 2/2010 | Zhang | 439/884 |

FOREIGN PATENT DOCUMENTS

CN 2531587 1/2003

* cited by examiner

*Primary Examiner* — Chandrika Prasad
(74) *Attorney, Agent, or Firm* — Andrew C. Cheng; Wei Te Chung; Ming Chieh Chang

(57) ABSTRACT

An electrical connector (100) includes an insulative housing (1) defining at least a passageway (11) and a mating face (101), at least a contact terminal (2) received in the passageway (11) and having a contact arm (24) extending beyond the mating face (101). The contact terminal (2) includes a base portion (23) with a cutout (233) providing a yielding space to receive a portion (241) of the contact arm (24) when it is depressed.

20 Claims, 5 Drawing Sheets

ELECTRICAL CONNECTOR HAVING CONTACT TERMINAL WITH CUTOUT RECEIVING DEPRRESSED CONTACT ARM

BACKGROUND OF THE INVENTION

1. Field of the Invention

The present invention relates to an electrical connector, and more particularly to a battery connector having a contact terminal with a cutout located at a base portion to receive a depressed spring arm.

2. Description of the Related Art

CN Pat. No. 2531587 issued to Huang on Jan. 15, 2003, discloses a battery connector for a mobile phone. The connector includes an insulative housing and a pair of contact terminals retained in the housing. The insulative housing has two cutouts for receiving the contact terminals therein. Each of the contact terminals defines a retaining portion retained in the housing, an S-shaped spring base portion upwardly extending into the slot from one end of the retaining portion and a soldering portion extending outwards from another end of the retaining portion. The spring base portion includes a protruding contacting arm disposed outside of the cutout for electrically connecting with a complementary object, e.g. a battery.

When the complementary object presses on the spring base portion downwards, the spring base portion will draw back into the cutout and engage with a stopping side-wall formed by the insulative housing for positioning thereof. However, when the spring base portion is shrunk to a lowest height, the contacting arm will mechanically interfere with the other part of the contact terminal and then lose of elasticity. Furthermore, the spring base portion could be lack of spring space, because the height size of the connector is limited for adapting to miniaturization of the connector. So, the electrical connection between the battery connector and complementary object is directly influenced by the elasticity of the contact terminals.

Therefore, an improved electrical connector is desired to overcome the disadvantages of the related arts.

SUMMARY OF THE INVENTION

An object of the present invention is to provide a low-profile electrical connector overcoming disadvantage of the prior art in which its contact terminals lack of the elasticity.

In order to achieve the above-mentioned object, an electrical connector in accordance with a preferred embodiment of the present invention includes an insulative housing defining at least a passageway and a mating face, at least a contact terminal received in the passageway and having a contact arm extending beyond the mating face. The contact terminal includes a base portion with a cutout providing a yielding space to receive a portion of the contact arm when it is depressed.

Other objects, advantages and novel features of the invention will become more apparent from the following detailed description of the present embodiment when taken in conjunction with the accompanying drawings.

DETAILED DESCRIPTION OF THE INVENTION

Figure 1:
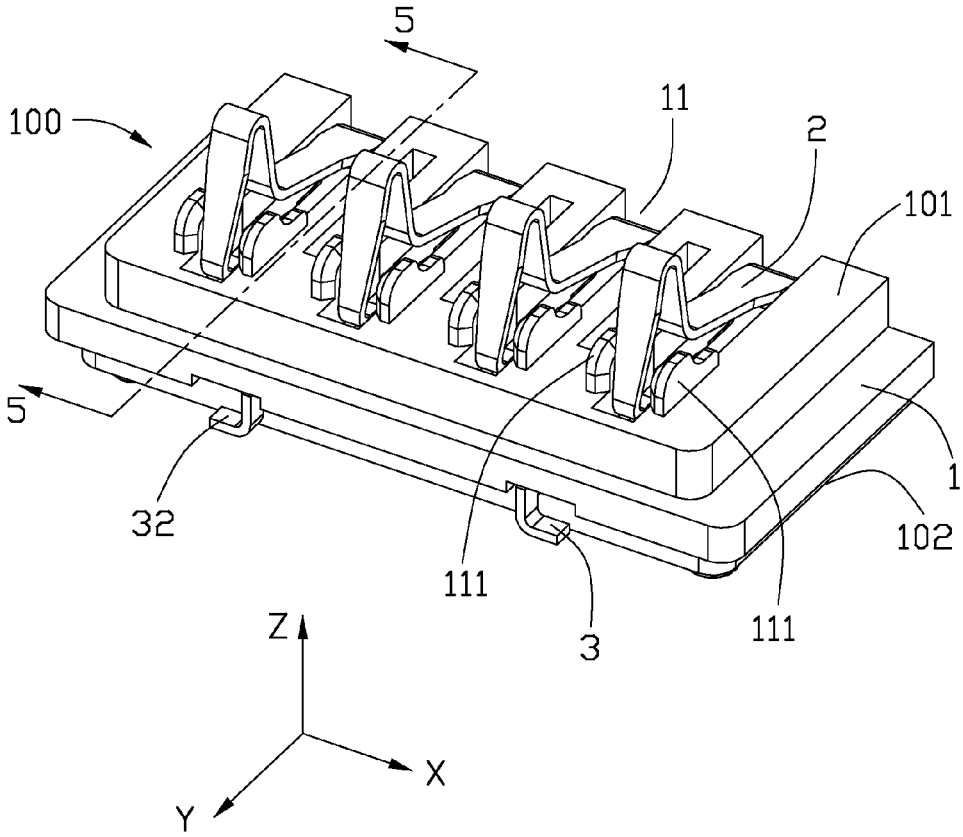
FIG. 1 is a perspective view of an electrical connector in accordance with the preferred embodiment of the present invention.

Reference will now be made to the drawing figures to describe the preferred embodiment of the present invention in detail.

Referring to FIG. 1, an electrical connector 100 which can electrically interconnect with a complementary object, e.g. a battery (not shown) is shown. The electrical connector 100 includes an insulative housing 1, a plurality of contact terminals 2 received and retained in the insulative housing 1 and a pair of metal ears 3 retained in the insulative housing 1 and disposed at opposite side of contact terminals 2 for soldering with a printed circuit board (not shown).

Figure 2:
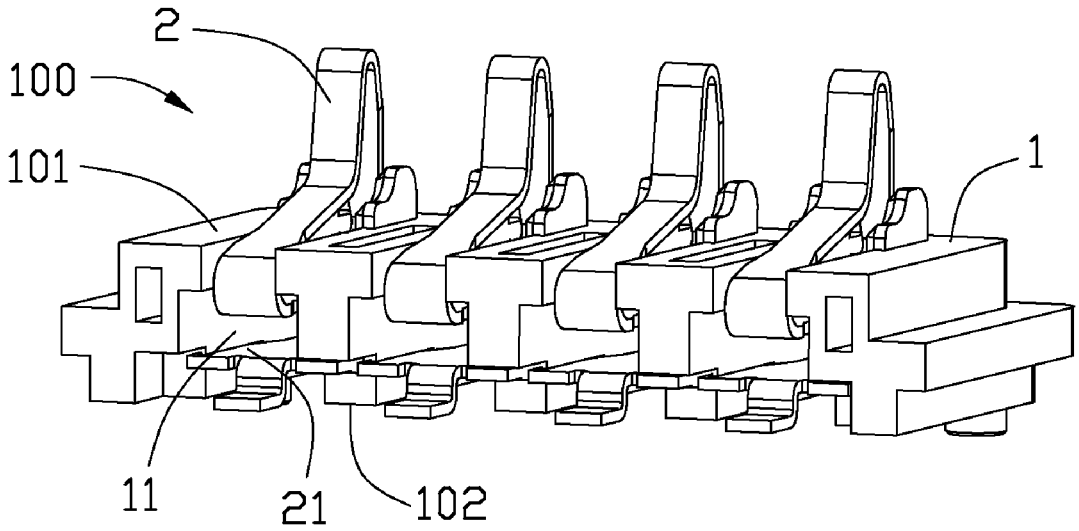
FIG. 2 is another perspective view of FIG. 1 viewed from a rear side thereof.
Figure 3:
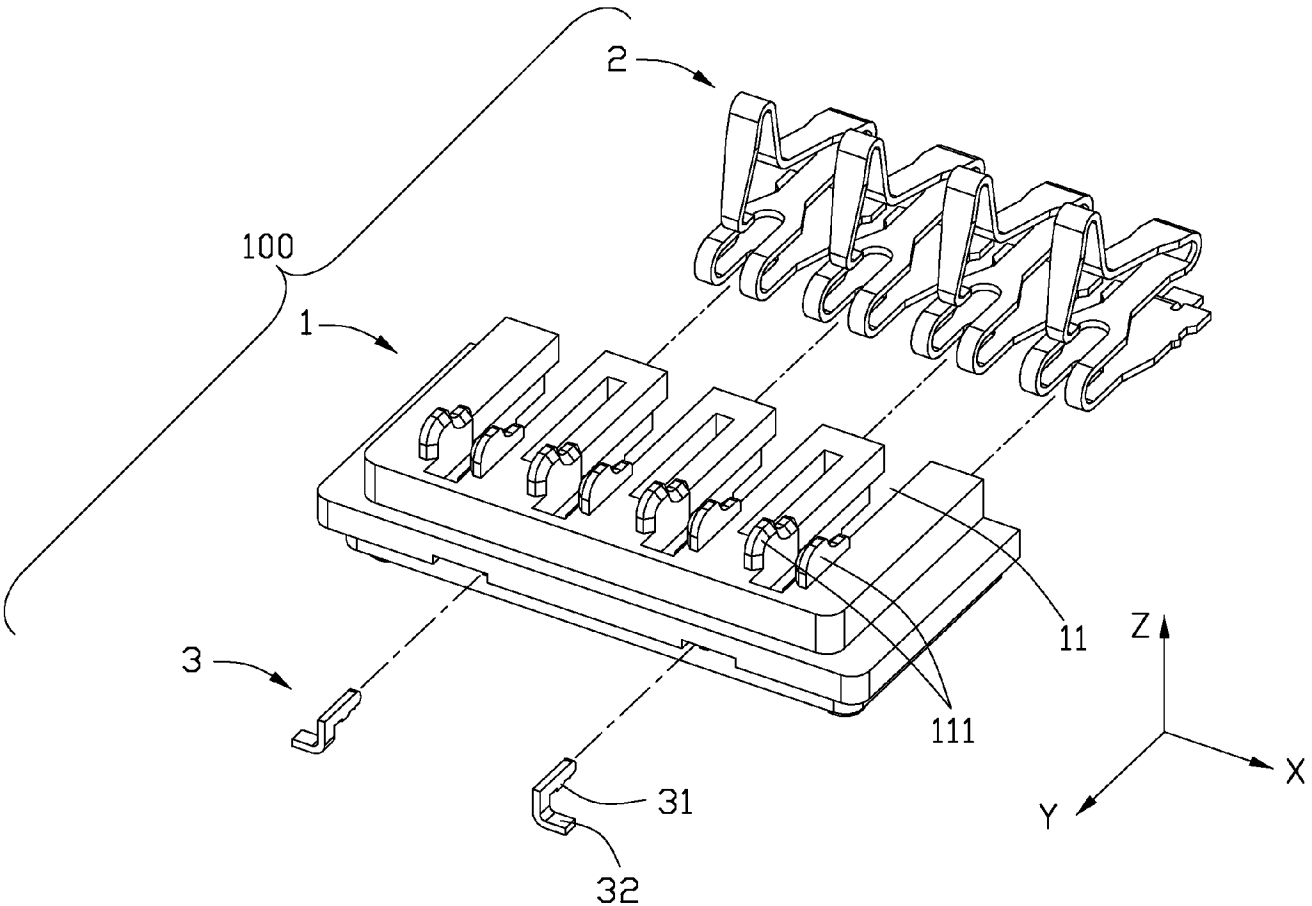
FIG. 3 is an exploded perspective view of FIG. 1.

Referring to FIGS. 1 to 3, the insulative housing 1 defines a plurality of passageways 11 arranged in a first direction (as arrowed by X), each of the passageways 11 is extending along in a second direction (as arrowed by Y) perpendicular to the X direction and running through the insulative housing 1 along an opposite direction (as marked by Y') of the Y direction for receiving the contact terminals 2 inserted thereinto. The contact terminals 2 are separately inserted into the passageways 11 in a predetermined interval in the X direction. The insulative housing 1 has a top mating face 101 and a bottom mounting face 102 opposite to the top mating face 101 at a mating direction (as arrowed by Z) perpendicular to the X direction and the Y direction. Furthermore, the passageways 11 are extending through the top mating face 101 and the bottom mounting face 102 in the X direction to provide enough moving space for the contact terminals 2 not be limited by the insulative housing 1.

Figure 4:
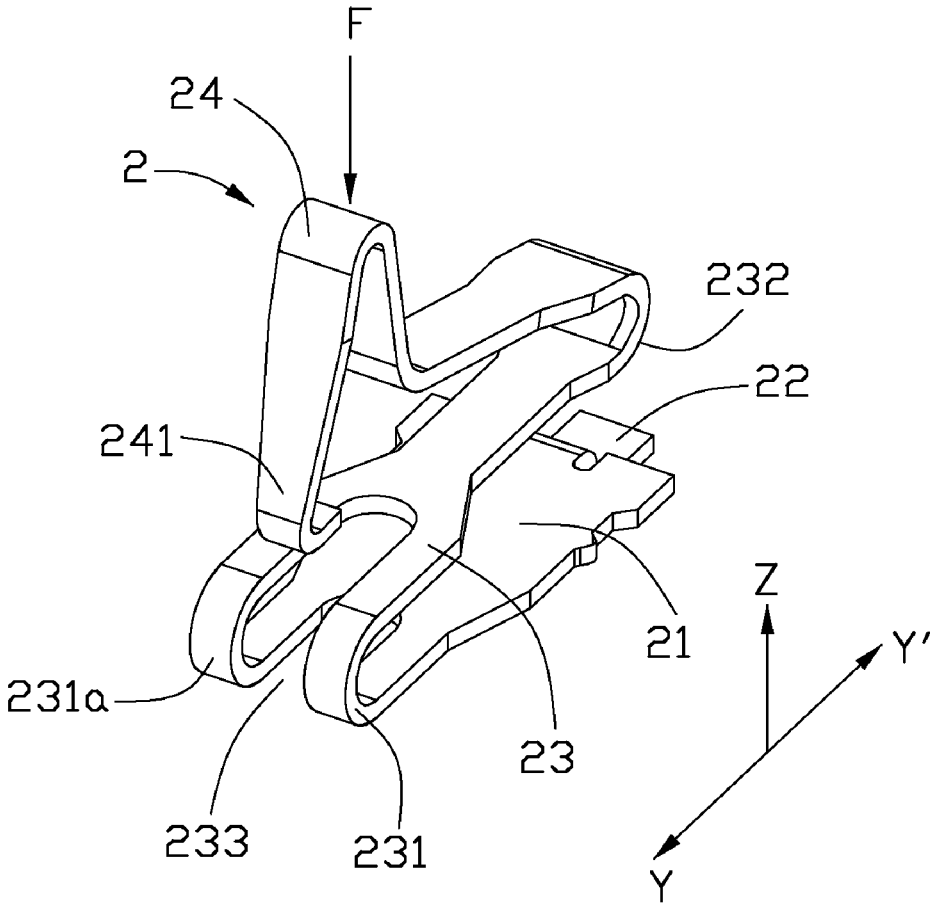
FIG. 4 is a perspective view of the contact terminal of FIG. 3.
Figure 5:
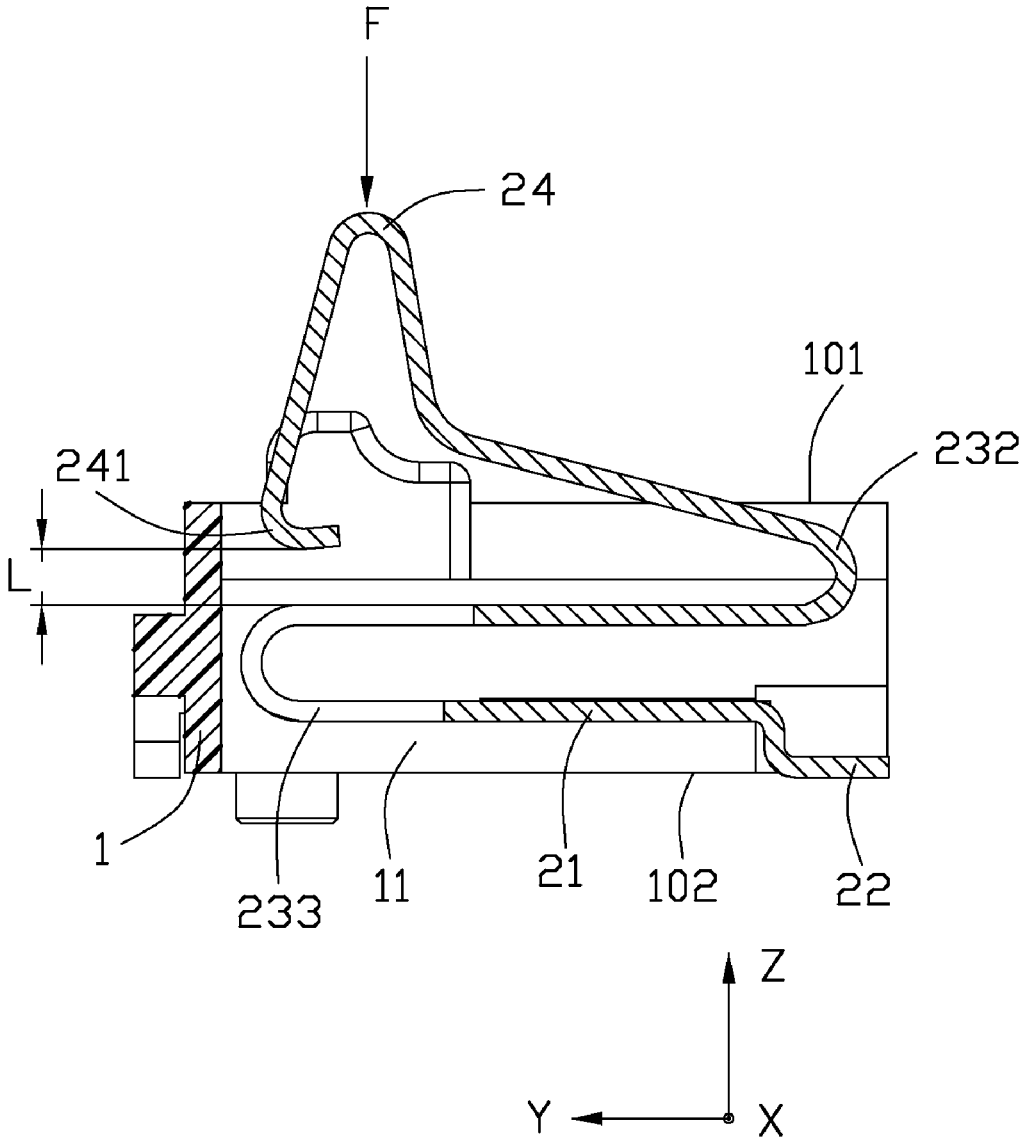
FIG. 5 is a cross-section view of the electrical connector taken along line 5-5 of FIG. 1.

Referring to FIGS. 4 to 5, each of the contact terminals 2 includes a retaining portion 21 retained in the insulative housing 1, a soldering portion 22 extending from one end of the retaining portion 21 along the Y' direction to solder with the printed circuit board, a spring base portion 23 extending from another end of the retaining portion 21 and a contact arm 24 continually extending from the spring base portion 23 and extending beyond the mating face 101. The spring base portion 23 is provided with a first U-shaped folded portion 231 directly connecting with the retaining portion 21, a second U-shaped folded portion 232 continually extending from the first U-shaped folded portion 231 viewed from X direction, thereby forming an S-shaped configuration which has an enough elasticity. The contact arm 24 has a humped configuration for improving compressive strength of the contact terminals 2. The contact arm 24 also includes a free end portion 241 extending towards the first U-shaped folded portion 231 which defines a cutout 233 for receiving the free end portion 241 therein, i.e. the cutout 233 provides a yielding space to receive the free end portion 241 of the contact arm 24 when it is depressed by the battery. The cutout 233 extends through the first U-shaped folded portion 231 in the Z direction and forwardly extends through a front end 231*a* of the first U-shaped folded portion 231 for increasing an elasticity of the first U-shaped folded portion 231.

When the electrical connector 100 is not depressed by the battery, the contact arm 24 thereof is at an original state and forms a distance L from the first U-shaped folded portion 231. When they are mated with each other, the contact arms 24 are depressed downwardly by a mating force F. At the same time, the base portion 23 is depressed downwardly and deformed elastically. Therefore the contact arm 24 will draw back into the passageways 11 in the mating force F, the free end portion 241 thereof will be depressed into the cutout 233 from the original state for preventing the free end portion 241 from interfering with the first U-shaped folded portion 231. In such a structure that the contact terminal 2 will has an enough moving space and the elasticity thereof is also added for strengthening an electrical connection of the electrical connector 100 and the battery, but the height size of the electrical connector 100 in the Z direction is not increased for miniaturization and low profile.

Referring to FIGS. 1 to 3, the insulative housing 1 defines a protecting portion 111 alignment with the contact arm 24 in the X direction for preventing the contact arm 24 from moving overly and preventing the two adjacent contact terminals 2 from interfering with each other. The protecting portion 111 is protruded beyond the top mating face 101. The metal ear 3 has an L-shaped configuration and includes a barb portion 31 retained in the insulative housing 1 and a soldering pad 32 extending outwards from the barb portion 31 to soldering with the printed circuit board. The soldering pads 32 are disposed at opposite side of the soldering portions 22 of the contact terminals 2 for making the electrical connector 1 being steadily adhered on the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the board general meaning of the terms in which the appended claims are expressed.

What is claimed is:

1. An electrical connector, comprising an insulative housing defining at least a passageway, and a mating face;

at least a contact terminal received in the passageway and having a contact arm extending beyond the mating face; and wherein the contact terminal includes a base portion with a cutout providing a yielding space to receive a portion of the contact arm when it is depressed.

2. The electrical connector as described in claim 1, wherein the base portion comprises a first U-shaped folded portion and a second U-shaped folded portion extending from the first U-shaped folded portion, thereby forming a spring S-shaped configuration.

3. The electrical connector as described in claim 2, wherein the cutout extends through the first U-shaped folded portion in a mating direction.

4. The electrical connector as described in claim 3, wherein the cutout extends forwards through a front end of the first U-shaped folded portion.

5. The electrical connector as described in claim 3, wherein the insulative housing comprises a protecting portion alignment with the contact arm.

6. The electrical connector as described in claim 3, wherein the contact arm has a humped configuration.

7. The electrical connector as described in claim 4, wherein the free end portion is extended towards the first U-shaped folded portion, but forms a distance from the first U-shaped folded portion when the free end portion is at an original state thereof.

8. The electrical connector as described in claim 7, wherein the spring base portion comprises a retaining portion retained in the insulative housing, and directly connecting with the first U-shaped folded portion.

9. The electrical connector as described in claim 4, furthermore comprises a pair of metal ears, each defining an L-shaped configuration and including a barb portion retained in the insulative housing and a soldering pad extending outwards from the barb portion.

10. The electrical connector as described in claim 4, wherein the soldering pad are disposed at opposite side of a plurality of soldering portions formed by the contact terminals.

11. A contact terminal of an electrical connector, comprising:

a retaining portion;

a soldering portion extending from one end of the retaining portion;

a spring base portion extending from another end of the retaining portion;

a contact arm continually extending from the spring base portion and defining a free end portion extending towards the spring base portion; and wherein the base portion comprises a cutout opposite to the free end portion which is capable of moving into the cutout.

12. The contact terminal of an electrical connector as described in claim 11, wherein the spring base portion comprises a first U-shaped folded portion directly connecting with the retaining portion, a second U-shaped folded portion continually extending from the first U-shaped folded portion, thereby forming an S-shaped configuration which has an enough elasticity.

13. The contact terminal of an electrical connector as described in claim 12, wherein the cutout extends through the first U-shaped folded portion and extends forwards through a front end of the first U-shaped folded portion.

14. The contact terminal of an electrical connector as described in claim 13, wherein the free end portion is extended towards the first U-shaped folded portion, but forms a distance from the first U-shaped folded portion when the contact arm is at an original state thereof.

15. The contact terminal of an electrical connector as described in claim 14, wherein the contact arm has a humped configuration.

16. The contact terminal of an electrical connector as described in claim 15, wherein the spring base portion comprises a retaining portion retained in the insulative housing, and directly connecting with the first U-shaped folded portion.

17. An electrical connector comprising:

an insulative housing defining a plurality of passageways arranged along a transverse direction and each extending in a front-to-back direction perpendicular to said transverse direction and in communication with an exterior in a vertical direction perpendicular to both said front-to-back direction and said transverse direction; and a plurality of contacts disposed in the corresponding passageways, respectively, each of said contacts defining a lying U-shaped structure with retention mechanism on a lower arm of said lying U-shaped structure, a curved spring portion extending unitarily from a distal end of an upper arm of said lying U-shaped structure, and a peak type contact arm extending unitarily from the curved spring portion with an apex thereof; wherein a plurality of protecting pairs located upon an upper surface of the housing and located by two sides of the corresponding passageways, respectively, and the contact arm is essentially located with a range defined by the corresponding protecting pair in the front-to-back direction and the transverse direction in a top view.

18. The electrical connector as claimed in claim 17, wherein the upper arm defines a wide section and a narrow section, and said contact arm is located above the wide section in the vertical direction.

19. The electrical connector as claimed in claim 18, wherein said wide section defines a cutout dimensioned large enough to allow a free end section of the contact arm to pass therethrough when the contact arm is downwardly pressed by a corresponding electronic package.

20. The electrical connector as claimed in claim 19, wherein said cut out extends along the U-shaped structure into said lower arm.

* * * * *